US005893228A

United States Patent [19]

Rivera

[11] Patent Number: 5,893,228

[45] Date of Patent: Apr. 13, 1999

[54] SIGN FOR USE IN ENTRANCE OF HAZARDOUS CONFINED SPACE

[76] Inventor: Luis M. Rivera, P.O. Box 12714, Seattle, Wash. 98111

[21] Appl. No.: 08/885,680

[22] Filed: Jun. 30, 1997

[51] Int. Cl.[6] ..... G09F 15/00

[52] U.S. Cl. ..... 40/606; 40/124.07; 283/45

[58] Field of Search ..... 40/124.07, 306, 40/307, 611, 658, 666, 606, 660; 283/45, 46, 56

[56] References Cited

U.S. PATENT DOCUMENTS

| | | | |
|---|---|---|---|
| 684,886 | 10/1901 | Tobey | 404/606 X |
| 1,735,836 | 11/1929 | Pease | 40/611 |
| 2,001,679 | 5/1935 | Haughey | 40/306 |
| 3,002,306 | 10/1961 | Ruff, Sr. | 40/606 X |
| 3,237,330 | 3/1966 | Dinstbir | 404/606 X |
| 3,322,381 | 5/1967 | Bubb | 40/658 X |
| 4,019,269 | 4/1977 | Vix | 40/660 |
| 4,575,125 | 3/1986 | Angier | 283/117 |
| 4,750,668 | 6/1988 | Behne et al. | 229/87.08 |
| 5,647,154 | 7/1997 | Groves | 40/611 X |

*Primary Examiner*—Brian K. Green
*Attorney, Agent, or Firm*—Robert W. Jenny

[57] ABSTRACT

The apparatus includes a sign and clips which support it. The sign is installed against the wall of the opening into a hazardous, confined space. The sign is a strip of flexible signboard with indicia applied to both broad surfaces. There are several presentations of the message of the sign on each side with adjacent presentations inverted. The clips are attached to the wall of the opening so that the sign is supported at its lower edge to prevent it from falling into the space. The ends of the sign overlap so that a sign of one length is usable in a range of sizes of manholes.

1 Claim, 1 Drawing Sheet

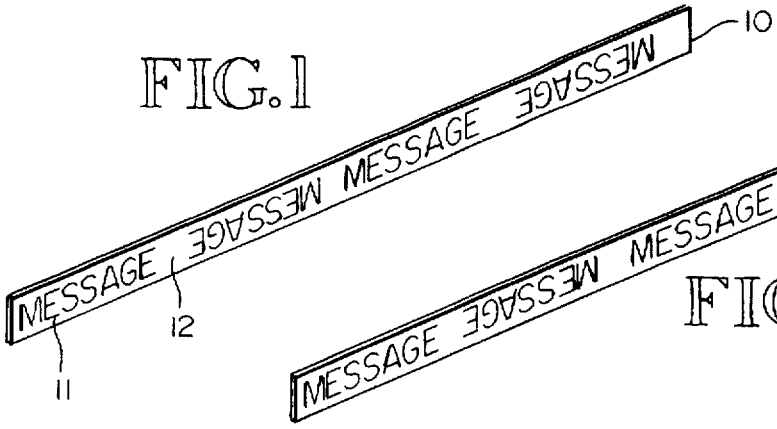
FIG. 1
FIG. 1A
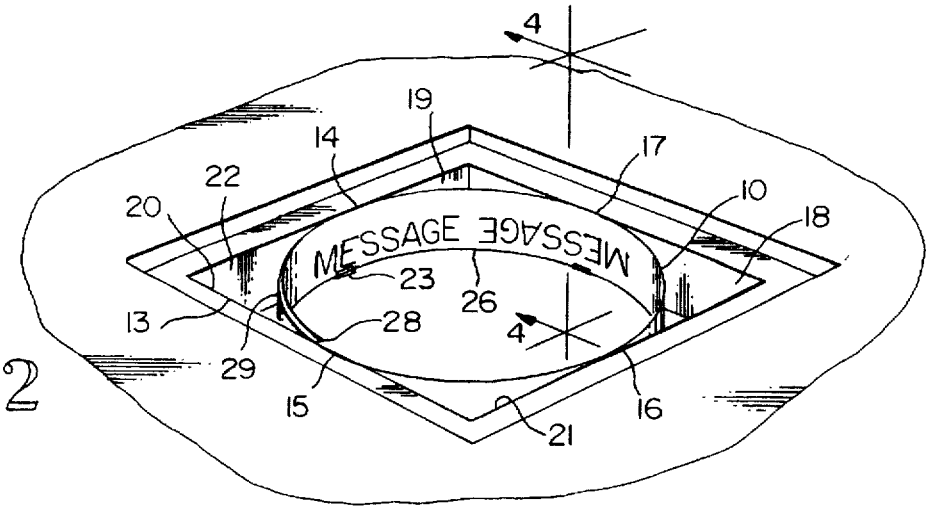
FIG. 2
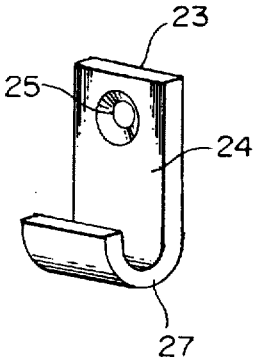
FIG. 3
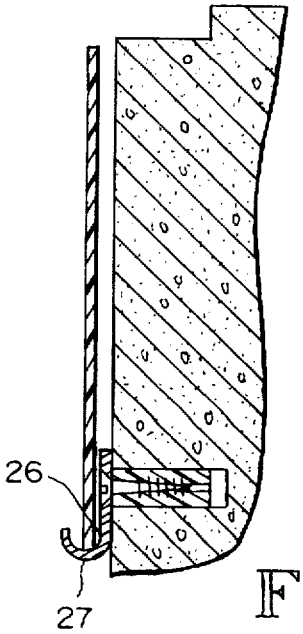
FIG. 4

SIGN FOR USE IN ENTRANCE OF HAZARDOUS CONFINED SPACE

BACKGROUND OF THE INVENTION

1. Field

The subject invention is in the field of signs and posters, particularly signs related to instructions about uses of exits and entries and authorization for and restrictions of such uses. More particularly, it is in the field of such signs which are easily and readily attachably installed and removed.

2. Prior Art

There is much prior art in this more particular field, patented and not. However, the need met by the subject invention is the result of recent legislation that requires that specific signs be installed in the entrances to confined spaces in which various hazards may exist, hazards which can be much more safely dealt with by personnel who have been trained and certified to do so. It is required that the signs be such that it is virtually impossible for a user not to notice the sign and be able to read it. Further, this requirement must be met without restrictions of the entrance. It is also required that the sign be easily and readily removed to limit damage to it during use of the entrance and easily and readily reinstalled when use is completed on each occasion. The primary objective of the subject invention is that it meet the legislated requirement as described. Secondary objectives are that the sign be durable and economical to manufacture and use.

SUMMARY OF THE INVENTION

The subject invention is a sign apparatus for use in the entrances to confined spaces, the entrance to a manhole being a highly representative example. Manholes are generally circular or rectangular (square) and beneath the cover there is an opening having a vertical wall a few inches high. The subject sign apparatus comprises a flexible rectangular sign board which fits against the wall and is supported by clips attached to the wall. With rectangular holes the signboard contacts the centers of the sides of the wall and the clips are at those centers. The sign board has indicia on both sides and form a cylinder when installed. The message presented by the sign is repeated a number of times on each side with adjacent presentations inverted with respect to each other. The result is that the message is visible to a person using the entrance regardless of how the sign is installed in the entrance. The sign is easily installed and removed and it is intended that it be removed during use of the entrance to minimize damaging the sign.

The invention is described below in more detail with reference to the attached drawings.

BRIEF DESCRIPTION OF THE DRAWINGS

FIG. 1 illustrates the signboard of the subject apparatus in its un-installed state.

FIG. 1A illustrates the signboard 10 as seen from the side not visible in FIG. 1.

FIG. 2 is a general view of the subject sign apparatus installed in a manhole having a square entrance.

FIG. 3 is a general view of one embodiment of the clips used to support the sign.

FIG. 4 is a section taken at 4—4 in FIG. 2

DETAILED DESCRIPTION OF THE INVENTION

The subject invention is a sign apparatus for use in the entrance of a hazardous confined space. FIG. 1 illustrates the signboard 10 of the subject apparatus. It is made of stiff, flexible, durable material such as polyvinyl choride. Indicia are applied to both sides of the signboard, providing a series of presentations of the message on each side, presentation 11 on side 12 being typical. Adjacent presentations are inverted, as shown, relative to each other so that the presented message can be read no matter how the sign is installed all the messages are identical.

FIG. 1A illustrates the signboard 10 as seen from the side not visible in FIG. 1.

FIG. 2 is a general view of the subject signboard apparatus installed in a manhole having a square entrance 13. Signboard 10 is placed in the entrance, contacting centers 14, 15, 16 and 17 of portions 18, 19, 20 and 21 of wall 22. It is supported on clips, clips 23 being typical, to prevent it from sliding into the manhole. FIG. 3 is a general view of one embodiment of the clips. Tab 24 of the clip is attached to the wall by adhesive or by a fastener inserted through hole 25. An edge 26 of the signboard rests in U-shaped portion 27 of the clip, as shown in FIG. 4, a section taken at 4—4 in FIG. 1.

The signboard forms a cylinder when installed as shown in FIG. 2, ends 28 and 29 of the sign (the signboard with indicia applied) may overlap without affecting the effectiveness of the apparatus. The overlapping enables use of a sign of one length in manholes in a range of sizes.

It is considered to be understandable from this description that the subject invention meets its objectives. It is believed that the sign itself is such that it is virtually impossible for a user of an entrance in which the sign is installed to not notice the sign and be able to read it. The sign does not restrict an entrance in which it is used and is easily and readily removed and installed. Also, it is durable and economical to manufacture and use.

It is also considered to be understood that while one embodiment of the subject apparatus is described above, other embodiments and modifications of the one described are possible within the scope of the invention which is limited only by the attached claims.

I claim:

1. A sign apparatus for use in a wall having an opening, said apparatus comprising:

a sign and a plurality of spaced apart means for supporting said sign in said opening with said sign contacting said wall, said sign comprising a signboard having first and second broad sides and indicia applied to said first and second sides, said signboard being a strip of stiff, flexible material formed into a cylinder, said indicia displaying a message and comprising a series of identical presentations of said message on each of said sides with adjacent presentations inverted with respect to each other.

* * * * *